US010556268B2

(12) United States Patent
Soliani

(10) Patent No.: US 10,556,268 B2
(45) Date of Patent: Feb. 11, 2020

(54) IMPROVEMENTS RELATING TO EQUIPMENT FOR THE MANUFACTURE OF ARTICLES MADE OF LIGHT ALLOY OR SIMILAR

(71) Applicant: ALUSTRATEGY S.R.L., Viale (IT)

(72) Inventor: Marco Soliani, Antignano (IT)

(73) Assignee: Alustrategy S.R.L., Viale (AT) (IT)

( * ) Notice: Subject to any disclaimer, the term of this patent is extended or adjusted under 35 U.S.C. 154(b) by 0 days.

(21) Appl. No.: 15/574,604

(22) PCT Filed: May 19, 2016

(86) PCT No.: PCT/IB2016/052950

§ 371 (c)(1),
(2) Date: Nov. 16, 2017

(87) PCT Pub. No.: WO2016/185424

PCT Pub. Date: Nov. 24, 2016

(65) Prior Publication Data

US 2018/0133787 A1 May 17, 2018

(30) Foreign Application Priority Data

May 20, 2015 (IT) ..... UB2015A0673

(51) Int. Cl.
*B22D 18/02* (2006.01)
*B22D 18/08* (2006.01)

(52) U.S. Cl.
CPC ..... *B22D 18/02* (2013.01); *B22D 18/08* (2013.01)

(58) Field of Classification Search
CPC .... B22D 17/2218; B22D 46/00; B22D 18/02; B22D 18/08
See application file for complete search history.

(56) References Cited

U.S. PATENT DOCUMENTS 4,583,579 A * 4/1986 Miki ..... B22D 17/32 164/113
2004/0154779 A1 8/2004 Frulla
(Continued)

FOREIGN PATENT DOCUMENTS

CN 1628005 A 6/2005
CN 202971570 U 6/2013
(Continued)

OTHER PUBLICATIONS

Beninca Cordes, et al., International Search Report and Written Opinion of the International Searching Authority, dated Aug. 17, 2016.

(Continued)

*Primary Examiner* — Kevin P Kerns
*Assistant Examiner* — Steven S Ha
(74) *Attorney, Agent, or Firm* — Danielson Legal LLC

(57) ABSTRACT

An apparatus for manufacturing items of light alloy or similar comprises a mould (10) that includes two half-moulds (12, 14), lower and upper, able to be coupled together. The lower half-mould (12) defines a moulding cavity (20) adjacent to a supply duct (16) of liquid metal that passes through it up to an introduction passage (18) of the liquid metal in the moulding cavity (20). The upper half-mould (14) is associated with at least one moveable punch (24) provided with a moulding surface (21) that defines the shape of an item to be moulded together with the moulding cavity (20). Each punch (24) performs the function of a shutter to stop the flow of liquid metal towards the moulding cavity (20). The apparatus includes temperature control means and temperature sensors connected with a control unit (32) that prevents the movement of the moveable punches (24) if the temperature of both half-moulds (12, 14) is not comprised within a predetermined range of values.

9 Claims, 3 Drawing Sheets

(56) References Cited

U.S. PATENT DOCUMENTS

Figure 1:
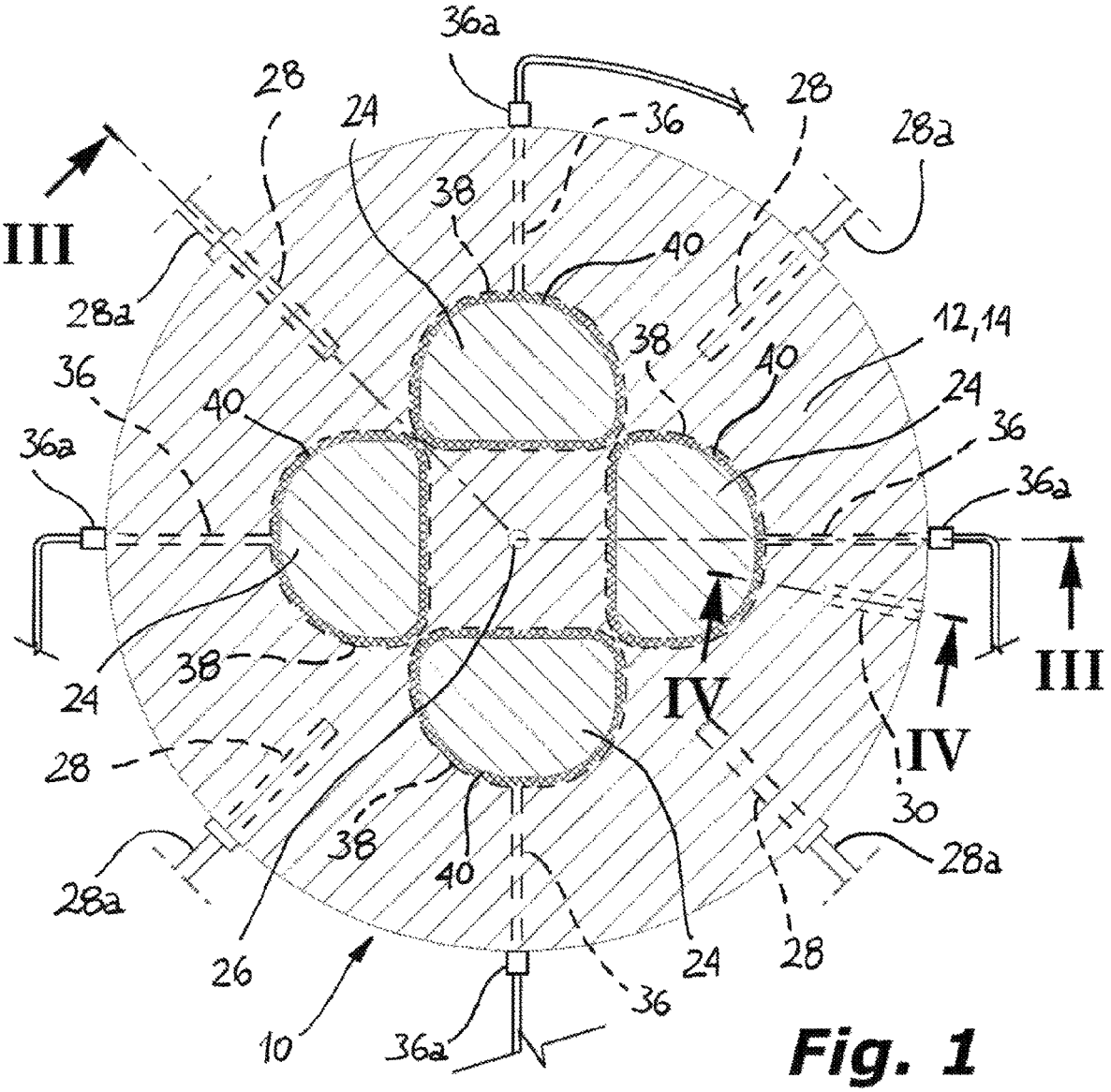

| | | | | |
|---|---|---|---|---|
| 2006/0000573 | A1* | 1/2006 | Shinki | B22D 17/2023 164/312 |
| 2009/0158795 | A1 | 6/2009 | Bonci | |

FOREIGN PATENT DOCUMENTS

| | | | |
|---|---|---|---|
| CN | 103658588 | A | 3/2014 |
| EP | 1472027 | A1 | 11/2004 |

OTHER PUBLICATIONS

Office Action for CN 201680024672.3, dated Jul. 26, 2019, 22 pages.

* cited by examiner

IMPROVEMENTS RELATING TO EQUIPMENT FOR THE MANUFACTURE OF ARTICLES MADE OF LIGHT ALLOY OR SIMILAR

The present invention refers in general to apparatuses for manufacturing items of light alloy, such as aluminium, aluminium alloy or similar.

More specifically, the invention concerns an apparatus of the type defined in the preamble of the attached claim 1.

EP-1 472 027 describes such an apparatus, which carries out a "liquid metal forging" process, also known as "squeeze casting". This known apparatus essentially comprises a lower half-mould and at least one upper half-mould that can be coupled together, the lower half-mould being crossed by a liquid metal introduction duct connected with a melting furnace of the metal arranged beneath the mould. In the lower half-mould at least one lower impression is defined adjacent to an edge of the liquid metal introduction duct, which has a concave portion intended to receive an amount of liquid metal fed through said duct and dosed by overflow from the edge of such a duct. The upper half-mould is associated with at least one moveable punch, able to move with respect to both half-moulds when they are in the closed configuration, which defines a surface able to be coupled with said at least one lower impression to delimit the shape of an item to be moulded. Each moveable punch also performs the function of a shutter to close the passage of the liquid metal after it has filled the concave portion of the relative lower impression.

This known apparatus has the purpose of obtaining items with a sprueless very compact structure, so as to avoid further processing of the items after their extraction from the mould at the end of the moulding step.

Despite this, tests carried out by the Applicant have demonstrated that this known apparatus is not very efficient in use, since after only a few production cycles the quality of the items obtained quickly degrades. Indeed, the structure of the items obtained with this known apparatus is generally not very compact, and they have clear burrs the removal of which requires that expensive finishing operations be carried out. Basically, already after just a few machining cycles, this known apparatus needs to be stopped to then be able to start it again after a preparation step, which is unacceptable in normal operation of the apparatus during industrial production.

In order to overcome these drawbacks, the object of the invention is an apparatus having the characteristics mentioned in the attached claims.

According to the invention, the mould comprises temperature control means of the upper and lower half-moulds, said control means including heating means and temperature sensor means associated with each half-mould, which are connected with an outer control unit adapted for preventing the movement of said at least one moveable punch if the temperature of both half-moulds is not comprised within a predetermined range of values.

In this way, the optimal thermal conditions of the mould are maintained during the moulding step carried out by the apparatus, which allows a high and constant quality of the moulded items to be obtained even after many moulding cycles have been carried out. In particular, thanks to these characteristics, it is possible to eliminate differentiated thermal dilation phenomena in the parts of the apparatus, which is essential in order to obtain a homogeneous and compact structure of the manufactured items, and also to keep the shutter function of the liquid metal introduction duct carried out by the punches reliable over time, which also makes it possible to avoid early wearing of the punches.

According to a preferred characteristic of the invention, the outer control unit is adapted for generating an approval to the movement of each moveable punch only if the temperature of both half-moulds is lower than the melting temperature of the liquid metal, and if the temperature difference of both half-moulds is less than a threshold value. This allows the thermal conditions of the two half-moulds to be effectively controlled so that they remain optimal during the entire moulding step.

According to another preferred characteristic of the invention, the upper half-mould comprises lubrication means of the movement of said at least one punch. Thanks to this characteristic the regular movement of the punch or of the punches of the apparatus is promoted during the sliding step with respect to the half-moulds, which contributes to keeping the quality of the items produced by the apparatus optimal, as well as further counteracting wearing phenomena of the punches, keeping their shutter function reliable.

Figure 2:
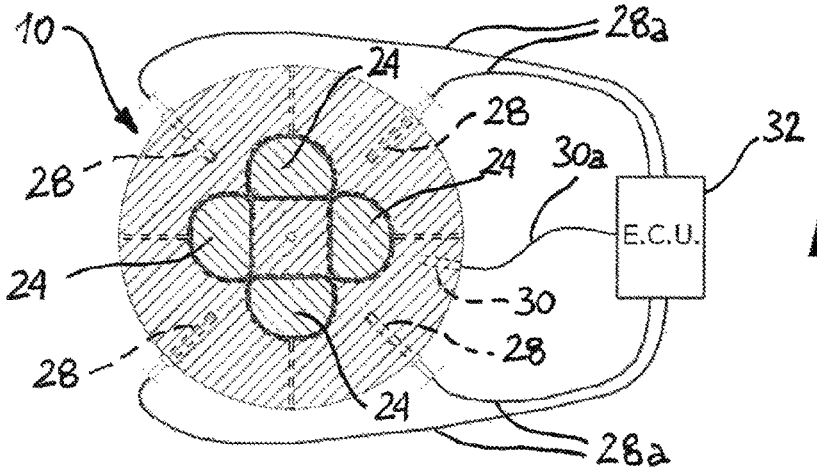
Figure 3:
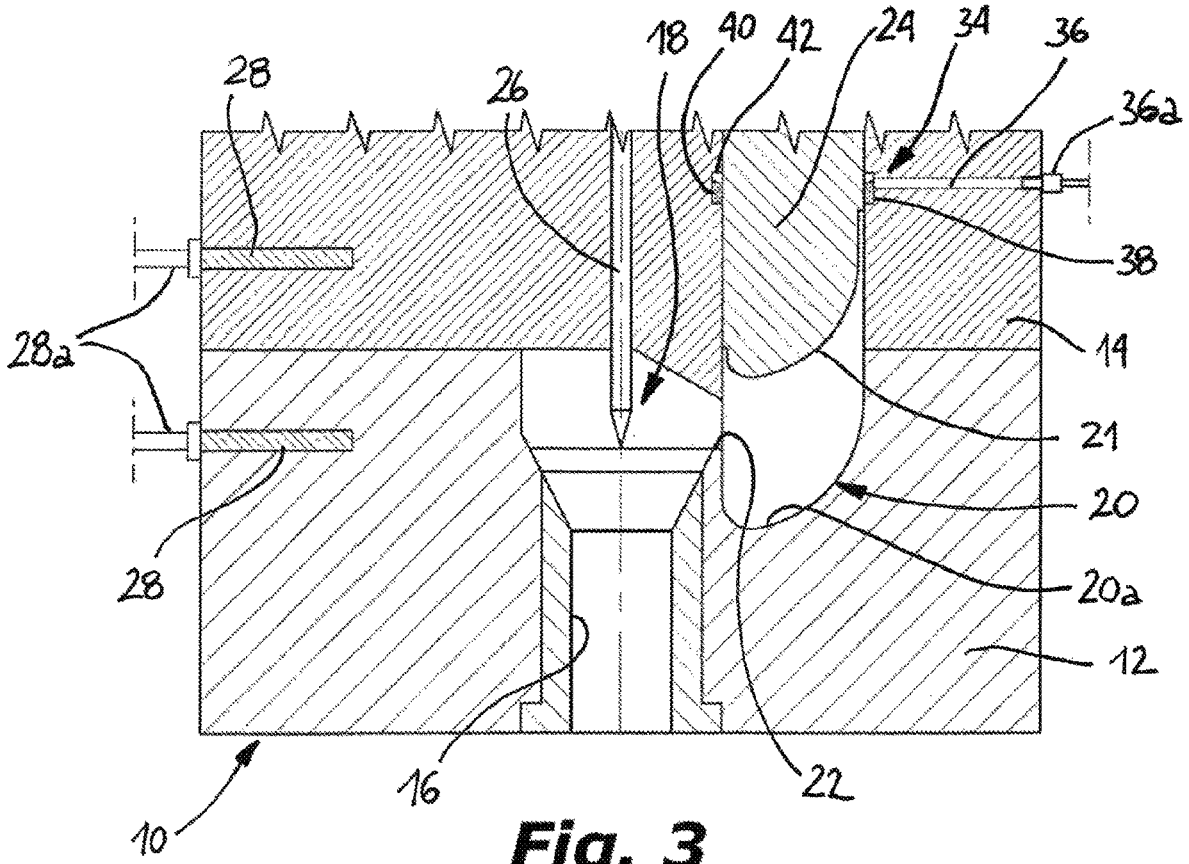
Figure 4:
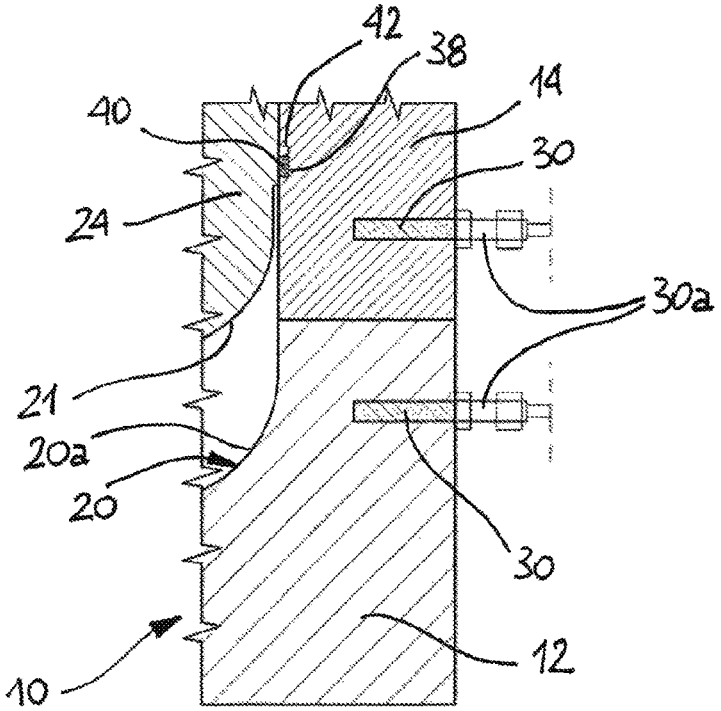
Figure 5:
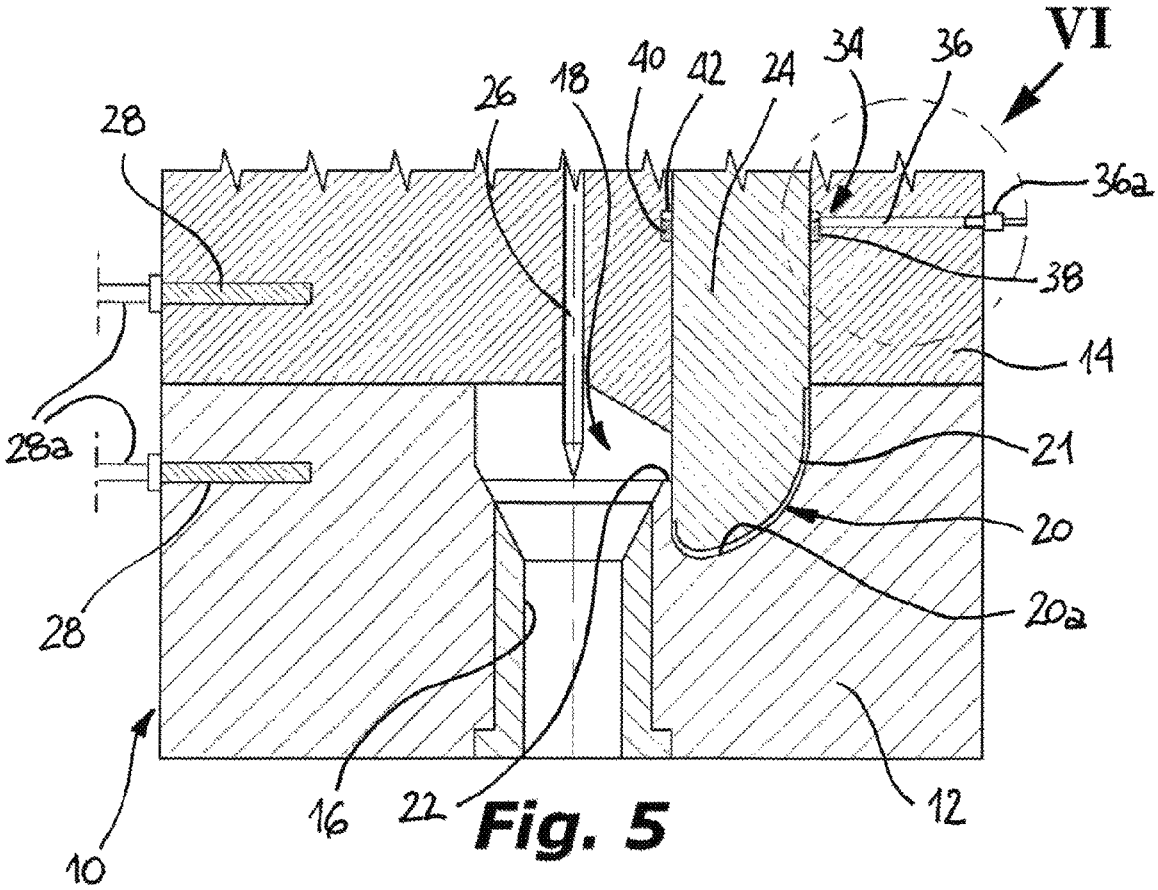
Figure 6:
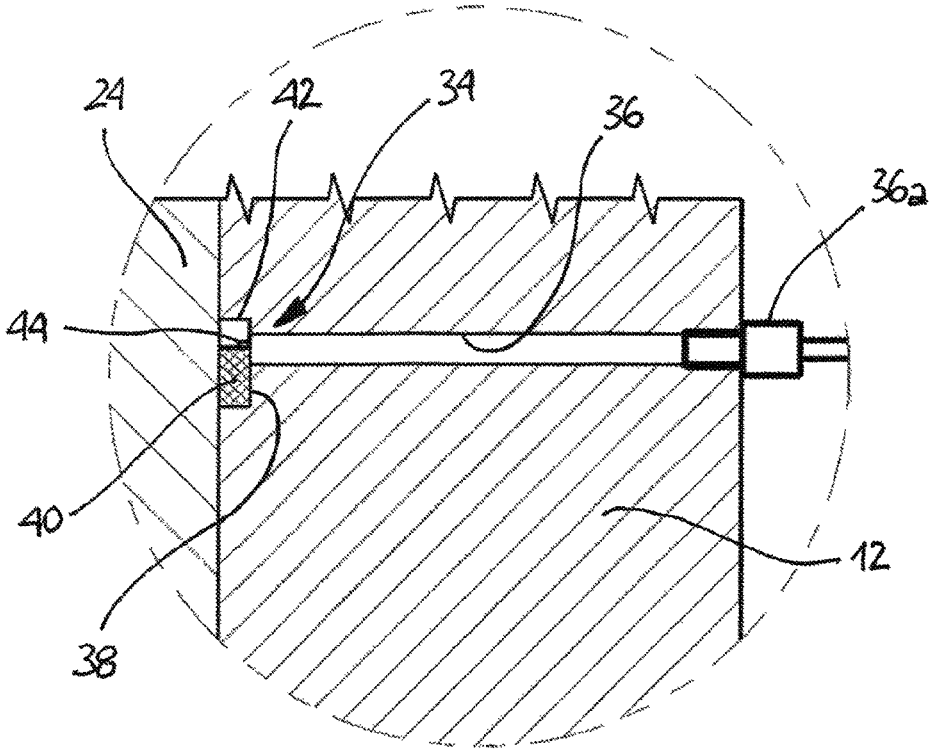

Further characteristics and advantages of the invention will become clearer from the detailed following description, provided for non-limiting purposes and referring to the attached drawings, in which:

FIG. 1 is a schematic top elevation view of the mould of the apparatus, sectioned along a horizontal plane at the level of its upper half-mould, FIG. 2 is a view similar to that of FIG. 1 in reduced scale, which also illustrates elements of the apparatus outside of the mould, FIG. 3 is a side elevation view of the mould of the apparatus sectioned along the line III-III of FIG. 1, in a configuration corresponding to a step prior to moulding of an item, FIG. 4 is another side elevation view that illustrates a detail of the mould of the apparatus sectioned along the line IV-IV of FIG. 1, in the same configuration as FIG. 3, FIG. 5 is a view similar to that of FIG. 3, in a configuration corresponding to the moulding step of an item, FIG. 6 is an enlarged view of a detail of FIG. 5 indicated by the arrow VI.

With reference to the figures, an apparatus for manufacturing items of light alloy or similar according to the invention comprises a mould wholly indicated with reference numeral 10. Purely as an example, the apparatus illustrated in the figures is intended to manufacture a plurality of toecaps for safety shoes in a single moulding operation.

The mould 10 comprises a lower half-mould 12 and an upper half-mould 14, both metallic, able to be coupled together in the closed configuration of the mould 10.

In particular, the lower half-mould 12 is intended to be removably fixed onto a support plane defined by a press (not illustrated in the drawings since of the per se known type) that allows the upper half-mould 14 to be moved vertically during the closing and opening steps of the mould 10, at the same time applying a pressure to such half-moulds.

The half-mould 12 is crossed, in a substantially central position, by a vertical supply duct 16 of liquid metal, and has, with reference to the embodiment illustrated in the figures, a moulding cavity 20 that includes four adjacent hollow impressions 20*a* that are separate with respect to such a duct 16, equally angularly spaced.

In particular, the supply channel 16 extends between a melting furnace (not illustrated) arranged beneath the half-mould 12, which is preferably of the pressurised type, i.e. capable of causing the liquid metal to rise along the duct 16 following a raising of the internal pressure of the furnace, and an introduction passage 18 formed in the half-mould 12. The channel 16 ends at the passage 18 with an upper end delimited by an overflow edge 22 of the liquid metal, intended to be passed over by the liquid metal at the moment of filling of the impressions 20*a* of the moulding cavity 20, just before the moulding step of the items.

For each impression 20*a* of the moulding cavity 20, the upper half-mould 14 comprises a respective punch 24, also metallic, slidably mounted with respect to it, so as to be moveable from and towards the lower half-mould 12. Each punch 24 has a lower moulding surface 21 adapted for defining the inner surface of an item to be moulded, so that the shape of an item to be moulded is delimited on opposite sides by the relative impression 20*a* of the moulding cavity 20 of the half-mould 12 and by the lower surface 21 of the punch 24 opposite it.

A side surface of each punch 24, facing towards the introduction passage 18, is adapted to carry out the function of a shutter to close a passage port of the liquid metal defined between the upper edge 22 of the supply channel 16 and a part juxtaposing it of the upper half-mould 14. In this way, the movement of a punch 24 towards the half-mould 12 causes the introduction passage 18 to close, so as to stop the flow of liquid metal towards the relative impression 20*a* of the moulding cavity 20. Thanks to the shutter function of the various punches 24, in each impression 20*a* of the cavity 20 of the lower half-mould 12 an amount of liquid metal is fed that is automatically dosed in a manner corresponding to the volume of metal necessary for each item to be moulded.

The mould 10 preferably comprises a level sensor 26, associated with the upper half-mould 14, which extends axially in the direction of relative movement between the two half-moulds 12 and 14, adapted for detecting a contact with the liquid metal to consequently stop the feeding of such metal from the melting furnace towards the introduction passage 18.

According to the invention, the mould 10 comprises means for controlling the temperature of the upper and lower half-moulds 12 and 14, which include heating members associated with both half-moulds 12 and 14, and temperature sensors of the same half-moulds.

Advantageously, the heating members include or consist of heating elements 28 of the electrical resistance type but, alternatively or in combination with the latter, it is possible to foresee a heating system of the heated fluid type. The heating elements 28 and the temperature sensors 30 are connected through respective ducts 28*a* and 30*a* with an electronic control unit E.C.U. 32 arranged outside of the mould 10 and intended to control, in response to the temperatures detected by the sensors 30, the movement of the punches 24.

In particular, after the step of filling the impressions 20*a* with the liquid metal, if the temperature of both half-moulds 12 and 14 is not comprised within a predetermined range of temperatures, for example selected in the range between 250 and 400° C., thus less than the melting temperature of the liquid metal, and if the temperature difference of the two half-moulds 12 and 14 is not less than a predetermined threshold value, for example of the order of a few tens of ° C., the E.C.U. 32 prevents the sliding of the punches 24 towards the half-mould 12. If at least one of the aforementioned conditions occurs, the E.C.U. 32 does not provide approval for the movement of the punches 24, and therefore the actuation of the mould 10, usually controlled by an operator, cannot happen because the punches 24 remain in their raised position with respect to the half-mould 12, preventing the closing of the passage port of the liquid metal between the introduction passage 18 and the impressions 20*a* of the moulding cavity 20. As an alternative to the actuation of the mould 10 controlled through intervention of an operator, such actuation can take place automatically, through control entirely managed by the E.C.U. 32.

In any case, the operative stop condition of the mould 10 remains so long as the temperature of the two half-moulds 12 and 14 does not reach the predetermined value.

Advantageously, each lower half-mould 12 comprises a number of heating elements 28 equal to the number of impressions 20*a* of the moulding cavity 20, each arranged between a pair of adjacent impressions 20*a* close to them. In an analogous manner, each upper half-mould 14 is provided with a number of heating elements 28 equal to the number of punches 24, each element 28 being arranged between a pair of adjacent punches 24 close to them.

Moreover, each half-mould 12, 14 comprises a single temperature sensor 30.

Preferably, the apparatus is provided with lubrication means associated with the upper half-mould 14, indicated in general with 34, to promote a uniform and constant movement over time of the punches 24 with respect to the half-moulds 12 and 14. In particular, these lubrication means 34 comprise, for each punch 24, an annular seat 38 that extends on a plane perpendicular to the direction of movement of the punches 24, formed in the upper half-mould 14 in a position facing the side surface of the relative punch 24, and in which an annular gasket 40 is arranged. Each annular seat 38 is connected with a supply channel of a lubricant fluid, typically oil, connected with a lubricant liquid tank (not illustrated) through relative ducts and connectors 36*a*.

Each gasket 40 has a porous structure, preferably consisting of fibres resistant to high temperatures, particularly artificial refractory fibres of mineral origin. For example, each gasket 40 can be obtained by shaping a relatively thin substrate of such refractory fibres, of any per se known type available on the market, in a manner corresponding to the relative annular seat 38.

Each annular seat 38 preferably has a lower portion in which the gasket 40 is received, and an upper throat 42, directly facing the supply channel 36, advantageously forming a ridge 44, for example shaped like a tooth, between the lower portion of the seat 38 and its upper throat 42, to hold the gasket 40 in the lower portion of the seat 38.

In the operation of the apparatus, the half-moulds 12 and 14 are brought towards one another following the actuation of the press on which the mould 10 is mounted. The pressurisation of the melting furnace arranged below the half-mould 12 is controlled, so as to make the liquid metal rise along the duct 16 until the introduction passage 18 is reached. From this passage 18 the liquid metal overflows into the various impressions 20*a* of the cavity 20, passing over the edge 22 until they are completely filled. The level sensor 26, having detected the presence of liquid metal, stops the pressurisation of the furnace, so that the level of the liquid metal goes back down in the duct 16.

In this step the heating members of the half-moulds 12 and 14 are normally active, which allow such half-moulds to assume a predetermined temperature for the moulding step, detected through the sensors 30. This temperature is comprised in a predetermined range, for example selected within the range between 250 and 400° C., therefore less than the melting temperature of the liquid metal, which is usually about 720° C. Moreover, the temperature difference of the two half-moulds 12 and 14 must not exceed a threshold value, typically of the order of a few tens of ° C., for example comprised between about 20 and 50° C.

The mould 10 is thus activated, normally by an operator, to carry out the moulding step.

If the values given above of the temperature of the half-moulds 12 and 14 do not fall within the foreseen ranges, the E.C.U. 32 does not allow the downward movement of the punches 24. Only when the temperature values of the half-moulds 12 and 14 fall within the set limits, the E.C.U. 32 provides an approval signal for the downward movement of the punches 24.

Following the movement of the punches towards the half-mould 12, they close the passage port towards the impressions 20*a* intercepting the liquid metal in the introduction passage 18 and thus exerting their shutter function. In this way, it is possible to obtain a precise and automatic dosing of the liquid metal in the various impressions 20*a* of the cavity 20, as a function of the volume of such impressions 20*a*, following the overflow of the liquid metal. The movement of the punches 24 with respect to the half-moulds 12 and 14 takes place in a perfectly regular and uniform manner thanks to the controlled temperature of the half-moulds and to the presence of the lubrication means 34.

The movement of the punches 24 downwards allows a pressure action to be exerted on the liquid metal in order to cause such metal to rise in the parts of the cavity of the mould 10 arranged at a higher level with respect to the edge 22, so as to obtain the filling of the entire moulding cavity of the mould 10 and to define the shape of the various items to be moulded between the impressions 20*a* of the cavity 20 and the relative moulding surfaces 21 of the punches 24. The extent of this pressure action is measured so that its application makes it possible to cause a compacting effect of the liquid metal, in order to obtain good structural uniformity of the moulded items and optimal mechanical strength thereof.

At the end of the moulding step of the items, the cooling step of the items takes place for a predetermined duration, at the end of which the punches 24 rise up moving away from the half-mould 12 to allow the half-moulds 12 and 14 to open and allow the removal of the moulded items from the mould 10.

The invention claimed is:

1. An apparatus for manufacturing items of light alloy comprising a mold, wherein the mold comprises a lower-half mold and at least one upper-half mold, wherein:

the lower-half mold and the at least one upper-half mold are configured to be able to be coupled together;

the lower-half mold defines at least one molding cavity adjacent to a supply duct of liquid metal that passes through the lower-half mold up to an introduction passage of the liquid metal in said at least one molding cavity, said supply duct being connected to a melting furnace arranged below the lower-half mold; and the at least one upper-half mold is associated with at least one punch moveable in the direction of the lower-half mold and has a molding surface adapted for defining, together with the at least one molding cavity, the shape of an item to be molded, said at least one punch configured to close the introduction passage and stop the flow of liquid metal towards the at least one molding cavity so that the amount of liquid metal received in the at least one molding cavity is dosed correspondingly to the volume of an item to be molded, characterized in that the mold comprises temperature control means of the at least one upper-half mold and the lower-half mold, said control means including a heating means and a first temperature sensor means associated with the at least one upper-half mold and a second temperature sensor means associated with the lower-half mold, wherein both the first temperature sensor means and the second temperature sensor means are connected with an outer control unit configured to prevent the movement of said at least one moveable punch if the temperature of both the at least one upper-half mold and the lower-half mold is not comprised within a predetermined range of values, characterized in that the outer control unit is adapted to generate an approval for the movement of each moveable punch only if the temperature of the at least one upper-half mold and the lower-half mold is less than the melting temperature of the liquid metal, and if a calculated temperature difference between a first temperature measured by the first temperature sensor and a second temperature measured by the second temperature sensor is less than a threshold value.

2. The apparatus according to claim 1, characterized in that said heating means of the half molds include heating elements of the electric resistance type and/or a heating system using heated fluid.

3. The apparatus according to claim 1, characterized in that each half mold is associated with a respective temperature sensor.

4. The apparatus according to claim 1, characterized in that the at least one upper-half mold comprises lubrication means for the movement of said at least one punch.

5. An apparatus for manufacturing items of light alloy comprising a mold, wherein the mold comprises a lower-half mold and at least one upper-half mold, wherein:

the lower-half mold and the at least one upper-half mold are configured to be able to be coupled together;

the lower-half mold defines at least one molding cavity adjacent to a supply duct of liquid metal that passes through the lower-half mold up to an introduction passage of the liquid metal in said at least one molding cavity, said supply duct being connected to a melting furnace arranged below the lower-half mold; and the at least one upper-half mold is associated with at least one punch moveable in the direction of the lower-half mold and has a molding surface adapted for defining, together with the at least one molding cavity, the shape of an item to be molded, said at least one punch configured to close the introduction passage and stop the flow of liquid metal towards the at least one molding cavity so that the amount of liquid metal received in the at least one molding cavity is dosed correspondingly to the volume of an item to be molded, characterized in that the mold comprises temperature control means of the at least one upper-half mold and the lower-half mold, said control means including a heating means and a first temperature sensor means associated with the at least one upper-half mold and a second temperature sensor means associated with the lower-half mold, wherein both the first temperature sensor means and the second temperature sensor means are connected with an outer control unit configured to prevent the movement of said at least one moveable punch if the temperature of both the at least one upper-half mold and the lower-half mold is not comprised within a predetermined range of values, characterized in that said at least one molding cavity comprises a plurality of separate impressions, the at least one upper-half mold being associated with a number of moveable punches corresponding to the number of impressions of the at least one molding cavity, the lower-half mold being equipped with a plurality of heating elements each of which is arranged between a pair of said impressions.

6. The apparatus according to claim 5, characterized in that each upper-half mold is equipped with a plurality of heating elements each of which is arranged close to a pair of punches, in a position arranged between two adjacent punches.

7. An apparatus for manufacturing items of light alloy comprising a mold, wherein the mold comprises a lower-half mold and at least one upper-half mold, wherein:

the lower-half mold and the at least one upper-half mold are configured to be able to be coupled together;

the lower-half mold defines at least one molding cavity adjacent to a supply duct of liquid metal that passes through the lower-half mold up to an introduction passage of the liquid metal in said at least one molding cavity, said supply duct being connected to a melting furnace arranged below the lower-half mold; and the at least one upper-half mold is associated with at least one punch moveable in the direction of the lower-half mold and has a molding surface adapted for defining, together with the at least one molding cavity, the shape of an item to be molded, said at least one punch configured to close the introduction passage and stop the flow of liquid metal towards the at least one molding cavity so that the amount of liquid metal received in the at least one molding cavity is dosed correspondingly to the volume of an item to be molded, characterized in that the mold comprises temperature control means of the at least one upper-half mold and the lower-half mold, said control means including a heating means and a first temperature sensor means associated with the at least one upper-half mold and a second temperature sensor means associated with the lower-half mold, wherein both the first temperature sensor means and the second temperature sensor means are connected with an outer control unit configured to prevent the movement of said at least one punch if the temperature of both the at least one upper-half mold and the lower-half mold is not comprised within a predetermined range of values, characterized in that:

the at least one upper-half mold comprises lubrication means for the movement of said at least one punch; and said lubrication means comprise, for each punch, an annular seat formed in the at least one upper-half mold in a position facing a side surface of the at least one punch, connected with a supply channel of a lubricant fluid, and in which an annular gasket is arranged.

8. The apparatus according to claim 7 characterized in that said annular seat has a lower receiving portion of said gasket, and an upper throat facing said supply channel of lubricant fluid.

9. The apparatus according to claim 7 characterized in that the annular gasket comprises fibers, wherein the fibers are artificial refractory fibers of mineral origin.

* * * * *